United States Patent [19]

Ratchford

[11] Patent Number: 4,457,469

[45] Date of Patent: Jul. 3, 1984

[54] COUPLING NUT FOR AN ELECTRICAL CONNECTOR

[75] Inventor: Lloyd G. Ratchford, Oneonta, N.Y.

[73] Assignee: The Bendix Corporation, Southfield, Mich.

[21] Appl. No.: 431,972

[22] Filed: Sep. 30, 1982

[51] Int. Cl.[3] ..... H01R 13/629

[52] U.S. Cl. ..... 339/89 M; 339/DIG. 2

[58] Field of Search ..... 411/296, 299, 300; 285/82, 85, 86, 87, 88, 84; 339/90 R, 90 C, 89 R, 89 C, 89 M, DIG. 2

[56] References Cited

U.S. PATENT DOCUMENTS

| | | | |
|---|---|---|---|
| 3,587,032 | 6/1971 | Normann | 339/89 M |
| 3,601,764 | 8/1971 | Cameron | 339/DIG. 2 |
| 4,109,990 | 8/1978 | Waldron et al. | 339/113 R |

FOREIGN PATENT DOCUMENTS

| | | | |
|---|---|---|---|
| 1389839 | 1/1965 | France | 339/DIG. 2 |

*Primary Examiner*—John McQuade

*Attorney, Agent, or Firm*—C. D. Lacina; R. J. Eifler

[57] ABSTRACT

A coupling nut (300) comprises inner and outer sleeves (310, 410) mounted for corotation about a connector shell (100) and about one another for movement between locked and unlocked positions and means (422) for normally biasing the sleeves into the locked position, the connector shell having a plurality of ratchet teeth (138) formed on an outer periphery thereof, the coupling nut including a plurality of spring beams (316) adapted to have a medial tooth (318) thereof normally biased from engagement with the ratchet teeth in the unlocked position and driven into engagement with the ratchet teeth in the locked position by drive pins (322) disposed within openings (312) on inner sleeve (310), outer sleeve (410) having an inner surface (406) for driving the drive pin (322) and spring beam (316) into the locked relationship and angularly spaced undercuts (408A, 408B) for receiving drive pin (322) when actuating sleeve is turned to the unlocked position.

14 Claims, 7 Drawing Figures

FIG. 1
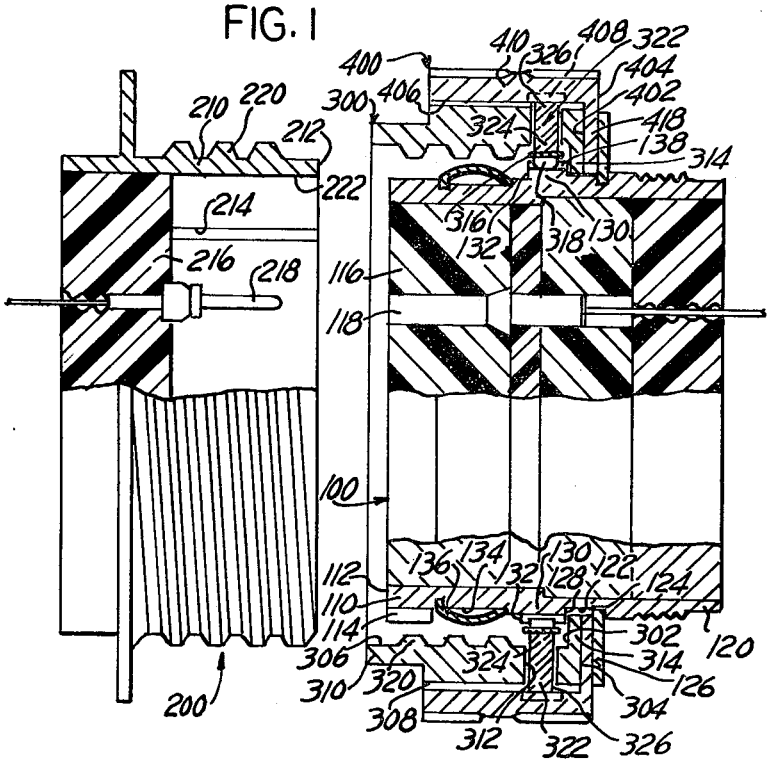
FIG. 6
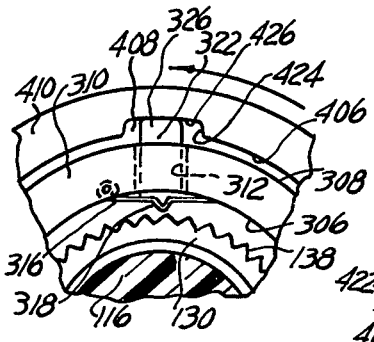
FIG. 7
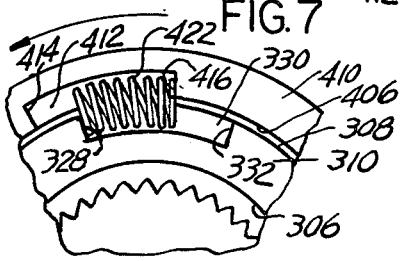
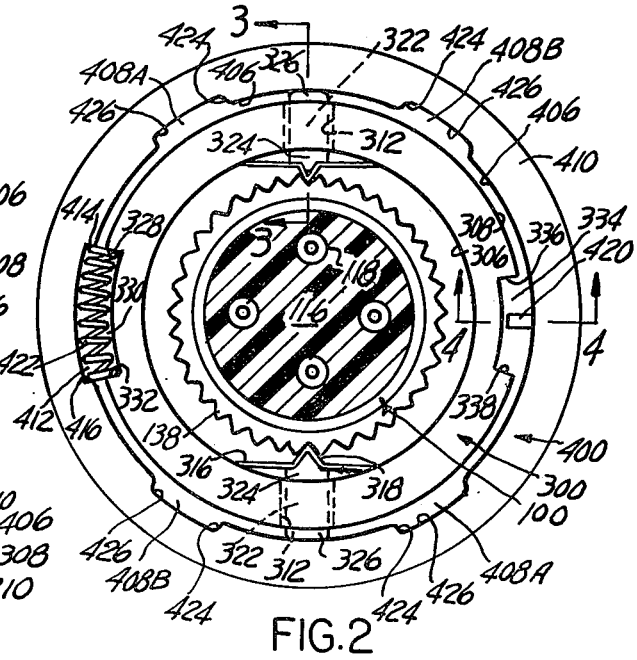
FIG. 2

COUPLING NUT FOR AN ELECTRICAL CONNECTOR

This invention relates to a coupling nut for an electrical connector and more particularly to a compound coupling nut positively locked from rotation in all positions of connection and including means initiated by a user for unlocking the coupling nut for coupling/uncoupling rotation relative to the connector.

An electrical connector assembly is generally comprised of two generally cylindrical connector shells, each shell retaining therein electrical contacts with the electrical contacts of one shell being mateable with the electrical contacts in the other shell when the connector shells are connected together by a coupling member. The coupling member is generally rotatably mounted to one of the connector shells by a retaining ring captivating a flange of the coupling member adjacent a shoulder of the one connector.

During mating and unmating, electrical connectors must be easily and quickly coupled and decoupled with use of reasonable forces. Once mated and in use, however, the electrical connector assembly must remain connected despite vibrational and/or other forces which might be applied to the connector assembly and which might uncouple the connectors. Various anti-rotation devices to prevent unwanted back-off and/or disconnection are known.

In "Electrical Connector Assembly Having an Anti-Decoupling Mechanism," U.S. Pat. No. 4,109,990 issuing Aug. 29, 1972 to Waldron, et al., a straight spring beam has its ends mounted to the coupling nut and constantly biases a medial tooth thereof into co-acting engagement with ratchet teeth disposed around an annular shoulder extending from the connector shell for resisting relative rotation therebetween. However, some vibration environments may cause the straight spring beam with its tooth to allow back-off between teeth of perhaps one or two clicks and the connector shells to undergo axial back-off from metal-to-metal contact resulting in hammering between connector shells. After 500 or more cycles of constant rotational engagement between the medial tooth and the ratchet teeth, the ratchet teeth and medial tooth will wear down and the force to resist uncoupling is reduced. Due to this reduction in decoupling force, the coupling nut tends to back-off during vibration exposure.

This invention provides an electrical connector assembly including a coupling nut and an anti-decoupling device with a locking arrangement which is self locking and which promotes locking of the coupling nut relative to its associated plug shell at all positions of the connector relative to the coupling nut and which unlocks resistance to user desired rotation. More specifically, the anti-decoupling device comprises coaxially disposed, rotatably mounted, inner and outer coupling and actuating sleeves with the coupling sleeve including an opening extending radially therethrough, a spring beam mounted to the inner wall of the coupling sleeve and normally biasing a medial tooth thereof radially outward from engagement with ratchet teeth on the plug shell, a drive pin protectively mounted for radial movement within the opening and associated with the spring beam, the actuating sleeve including spaced undercuts in its inner wall and adapted to turn between first and second positions relative to the coupling sleeve, the first position representing a lock position wherein the undercuts are disposed on each side of the drive pin and the inner wall thereof drives the drive pin and associated spring beam tooth radially inwardly and against the ratchet teeth, the second position representing an unlocked position wherein one of the undercuts register with the drive pin and the spring beam deflects the drive pin radially outwardly from engagement with the ratchet teeth and means including a rotary lost motion connection for biasing the sleeves into the first and locked position.

One way of carrying out the invention is described below with reference to the drawings which illustrate one specific embodiment of this invention, in which:

FIG. 1 is a side view, partially in section, of an electrical connector assembly having a coupling nut.

FIG. 2 is an end view of the assembly of FIG. 1 in a locked position.

FIG. 6 is an end view of the coupling nut in an unlocked position.

FIG. 7 is an end view of the coupling nut in an unlocked position.

Figure 3:
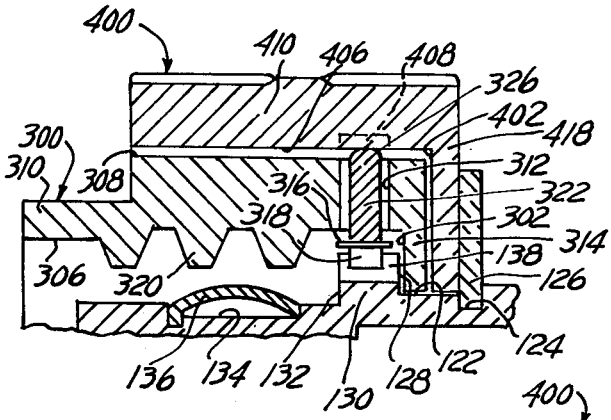
FIG. 3 is a partial side view in section taken along lines III—III of FIG. 2.

Referring now to the drawings and FIG. 1 in particular, an electrical connector assembly according to the present invention includes coaxial first and second shells 100, 200 positioned for mating engagement and a coupling nut 300 mounted for rotation to first shell 100 for connecting the first shell and second shell in mating relationship.

The first shell 100, also considered a plug-type connector, comprises a cylindrical front portion 110 having a front face 112, a rear portion 120 and an annular shoulder 130 medially of the shell portions, rear portion 120 including a stepped groove 124 and an annular wall 122 circumjacent the annular shoulder. The annular shoulder 130 includes a front face 132, a rear face 128 and a plurality of ratchet teeth 138 on its circumference. The first shell also includes one or more female-type (i.e., socket) electrical contacts 118 retained therewithin by a dielectric insert 116. The outer surface of front portion 110 includes an axial key 114 for orienting first shell 100 relative to second shell 200. An annular recess 134 forwardly of and circumjacent annular shoulder 130 is adapted to receive a shield spring 136 for grounding the connector shells 100, 200 from radio frequency interference.

The second shell 200, also considered a receptacle-type connector, comprises a cylindrical front portion 210 having an interior wall 222, a front face 212 and external thread 220 on the outside surface thereof, the interior wall being adapted to clearance fit about the plug shell for compressing against the shield spring. Further, shell 200 includes an axial keyway 214 for receiving key 114 on first shell 100 and one or more male-type (i.e., pin) electrical contacts 218 that mate within the socket-type contacts 118 of first shell 100, the pin contacts 218 being retained within a dielectric insert 216 mounted therewithin. Of course, the pin-socket type contacts 218, 118 could be other than shown.

The coupling nut 300 is rotatably mounted on first shell 100 and includes a cylindrical coupling sleeve 310 having an outer wall 308, an inner wall 306 having internal thread 320 thereon and an inwardly extending radial flange 314 having inner and outer end walls 302, 304, the internal thread 320 being adapted to connect with the external thread 220 on second shell 200 to axially draw the first and second shells 100, 200 together with contacts 118, 218 mated and the radial flange 314 being received about annular wall 122 and captivated for rotation against rear face 128 of annular shoulder 130 by a retaining ring 126 received within stepped groove 124.

Rotation of coupling nut 300 advances front portion 110 of first (plug) shell 100 axially inwardly into front portion 210 of second (receptacle) shell 200, the inner wall 222 of the receptacle shell 200 compressing shield spring 136 radially outwardly towards annular recess 134 of the plug shell 100. Continued rotation advances front face 212 of receptacle shell 200 into abutment against front face 132 of annular shoulder 130 when a full mate condition is achieved.

Preferably and in accord with this invention, coupling nut 300 is a compound-type coupling member which comprises a generally cylindrical, actuating nut 400 coaxially mounted for corotation relative to coupling nut 300 and to the plug shell 100, actuating nut 400 comprising a cylindrical actuating sleeve 410 having an inner surface 406 clearance fit about coupling sleeve 310 and including an inward radial flange 418 having an inner end wall 402 abutting the other radial flange 314, and a coil spring 422 (see FIG. 2) disposed between the flanges and within inner surface 406 and outer wall 308, the coil spring 422 being adapted to constantly bias the respective sleeves 310, 410 into a first position.

Coupling sleeve nut 300 is one piece and comprises coupling sleeve 310 having a plurality of openings 312 disposed equiangularly thereabout and extending radially between its inner and outer walls 306, 308, a straight spring beam 316 having its ends mounted to inner wall 306 and a medial tooth 318 circumposed about ratchet teeth 138, the spring beam being registered with an opening 312 and adapted to normally bias its medial tooth radially outward from engagement with the ratchet teeth 138, and a radially movable drive pin 322 associated with each respective spring beam 316, each drive pin 322 being adapted to be cammed radially inward by inner surface 406 of the actuating sleeve 410, the first position registering inner surface 406 with the drive pin and locking the coupling nut and rotation of sleeve 410 to the second position relative to the coupling sleeve 310 unlocking the drive pin and allowing the coupling nut to rotate.

Actuating nut 400 is one-piece and comprises the cylindrical actuating sleeve 410 having inner surface 406 thereof clearance fit about outer wall 308 of coupling sleeve 310 and radial flange 418 defining, respectively, inner and outer end walls 402, 404 with inner end wall 402 abutting against outer end wall 304 of radial flange 314. To receive the drive pin, unlocking undercuts 408A, 408B, shown in phantom, are disposed on inner surface 406.

Drive pin 322 is adapted to fit in each opening 312 and includes a first end 324 cooperatively attached to spring beam 316 and a domed end 326 adapted to engage with inner surface 406 of actuating sleeve 310.

As shown, the spring beams 316 are disposed in their locked position wherein medial tooth 316 is engaged within a valley of one of the respective ratchet teeth 138 and driven thereagainst by drive pins 322 with the actuating sleeve 410 positioning inner surface 406 against drive pin 322 to lock coupling sleeve 310 against rotation relative to actuating sleeve 410 or plug shell 100.

FIG. 2 is an end view through plug shell 100 showing coaxial detail of coupling nut 300 in the locked position. Two spring beams 316 are equiangularly spaced from one another and each beam has its respective medial tooth 318 locked within the ratchet teeth 138 by respective drive pins 322, each drive pin 322 being disposed within their respective opening 312 and each having their first end 324 engaged with spring beam 316 and domed end 326 cooperatively in abutment with inner surface 406 of actuating sleeve 410. This is a locked position at rest.

Disposed within inner surface 406 substantially equiangularly from the axis of each drive pin 322 rest position are, respectively, first and second unlocking undercuts 408A, 408B, each undercut being sized to receive an axial end portion of each respective drive pin 322 biased therein by its associated spring beam 316 when actuating sleeve 410 is rotated, respectively, in coupling and/or uncoupling directions, to register the unlocking undercuts therewith. Each undercut 408A, 408B is a continuation of inner surface 406 and comprises a tapered wall 424 defining a cam for each respective undercut and a radial wall 426 defining an outer limit of radial travel for the pin.

A spring housing is defined by confronting spring cavities 412, 330 disposed, respectively, within inner surface 406 and outer wall 308 on the sleeves 410, 310, each spring cavity 412, 330 spacing first spring seats 414, 328 from second spring seats 416, 332. A coiled operating spring 422 is positioned in each of the spring cavities 412, 330 so as to have its ends abutting each of the spring seats to position the undercuts 408A, 408B in spaced relation to the drive pin 322 for the locked position, the operating spring being compressed by adjacent spring seats when actuating sleeve 410 is rotated relative to coupling sleeve 310, operating spring 422 constantly acting to restore the sleeves 310, 410 and drive pins 322 to their locked position.

A limit cavity 334 having angularly spaced sidewalls 336, 338 is disposed on coupling sleeve 310 and adapted to receive a drive foot 420 extending from inner surface 406 of actuating sleeve 410, relative lost motion corotation between actuating sleeve 410 and coupling sleeve 310 causing drive foot 420 to have diminished effect on coupling sleeve 310 rotation until nearly in abutment with either of the sidewalls, sidewall 336 representing maximum angular corotation of actuating sleeve 410 relative to coupling sleeve 310 in one direction (e.g., coupling) and sidewall 338 representing maximum angular corotation of actuating sleeve 410 relative to coupling sleeve 310 in the other (e.g., uncoupling) direction, the relative corotation of acutating sleeve 410 about coupling sleeve 310 registering unlocking undercuts 408A, 408B with drive pins 322.

FIG. 3 shows enlarged detail of the coaxial arrangement between actuating sleeve 410 and coupling sleeve 310 with drive pin 322 being disposed in opening 312, inner surface 406 forcing domed end 326 of drive pin 322 radially inwardly against spring beam 316 and medial tooth 318 of the spring beam being driven deeply into engaged relation within a valley of one of the contiguous succession of peaks and valleys forming the ratchet teeth 138.

Figure 4:
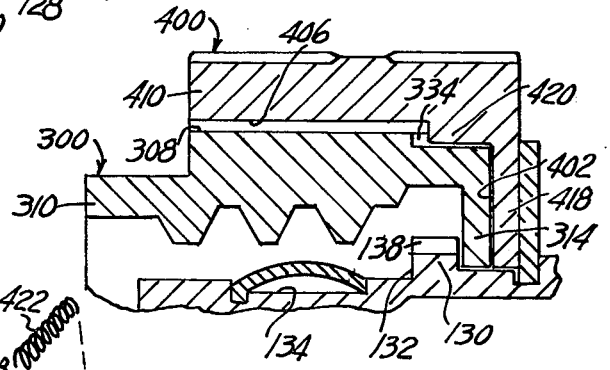
FIG. 4 is a partial side view in section taken along lines IV—IV of FIG. 2.
Figure 4:
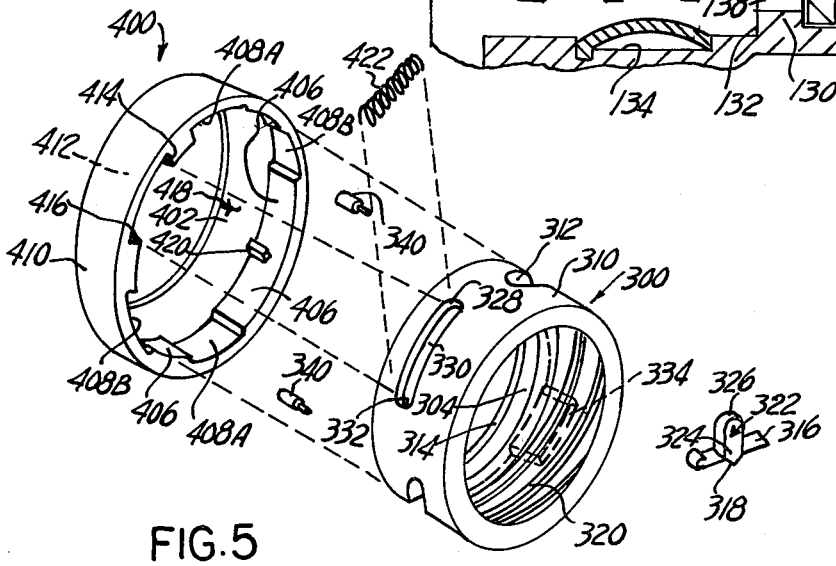

FIG. 4 shows drive foot 420 disposed within limit cavity 334. Drive foot 420 is integrally formed with actuating sleeve 410 and extends radially inwardly and longitudinally forward along inner surface 406 from inner end wall 402 of radial flange 418. Limit cavity 334 is formed into outer wall 308 of coupling sleeve 310 and extends longitudinally forward from radial flange 314.

Figure 5:
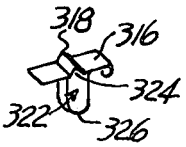
FIG. 5 is an exploded view of the coupling nut.

FIG. 5 is an exploded view of coupling nut 300 and actuating nut 400 with actuating sleeve 410 having inner surface 406, undercuts 408A, 408B, radial flange 418 and drive foot 420; coupling sleeve 310 having opening 312 through which drive pins 322 pass and (shown in phantom) limit cavity 334 for receiving drive foot 420; spring beams 316 associated with drive pins 322; and the spring cavities 330, 412 for receiving operating spring 422. Pegs 340 pivotally pin one end of each straight spring beam 316 coupling nut 300.

FIG. 6 shows uncoupling (i.e., unlocking) corotation of actuating sleeve 410 relative to coupling sleeve 310 wherein actuating sleeve 410 advances unlocking undercut 408 into register with drive pin 322 so that the domed end 326 of drive pin 322 is biased radially outward against tapered wall (cam) 424 so that an axial portion thereof is received within undercut 408 and domed end 326 is biased against radial wall 426, medial tooth 318 of spring beam 316 being biased radially outwardly from engagement with ratchet teeth 138.

FIG. 7 also shows uncoupling (i.e., unlocking) corotation wherein operating spring 422 has been compressed by the respective spring seats 328, 416 and thereby tending to restore the coupling nut and actuating nut into the locking position.

Coupling nut 300 would be assembled by inserting pegs 340 into coupling nut 300 to captivate spring beams 316 thereto and the drive pins 322 fit within openings 312, operating spring 422 fit within the spring housing formed between spring cavities 330, 412, coupling sleeve 310 aligned with actuating sleeve 410 in such fashion that limit cavity 334 is in register with drive foot 412 and the two sleeves slid one over the other and the sleeve assembly received over the rear portion 120 of plug shell 100 and captivated thereto by retaining ring 126 being positioned against radial flange 314.

To complete an electrical connector assembly, the shells 100, 200 would be positioned so that key and keyways 124, 224 are aligned and then axially advanced towards each other until external thread 220 on receptacle shell 200 is engaged by external thread 320 on coupling sleeve 310. As a result of actuating nut 400 rotation, the operating spring 422 is compressed and drive foot 420 advances against sidewall 336 and/or 338, depending upon the direction of rotation, in a lost motion, abutment with a sidewall by the drive foot then constraining the nuts 300, 400 to rotate together as a unit to draw the plug and receptacle shells 100, 200 together and with receptacle shell outside the plug shell and within the coupling nut. Substantially simultaneous with drive foot 420 abutting the sidewall, this relative corotation registers an unlocking undercut 408A, 408B with the drive pin 322, thereby allowing the spring beam to bias the drive pin radially outwardly into the undercut and the medial tooth from engagement with the ratchet teeth, disengagement of the teeth allowing resistanceless coupling/uncoupling. At any point where user constrained corotation of actuating sleeve 410 relative to coupling sleeve 310 is discontinued, the operating spring 422 drives the actuating sleeve back into its rest (i.e., locked) position, further rotation of the actuating sleeve 410 and coupling sleeve 310 relative to one another being prevented by medial tooth 318 being driven into the ratchet teeth 138.

Although the description of this invention has been given with reference to a particular embodiment, it is not to be construed in any limiting sense, many variations and modifications possibly occuring to those skilled in the art.

I claim:

1. A coupling nut for an electrical connector assembly of the type having a pair of cylindrical mating shells (100, 200) with one shell (100) including a plurality of ratchet teeth (138) arranged annularly and extending radially outward and the other shell (200) having external thread (220) on an outside portion thereof; the coupling nut including a spring beam (316) having a medial tooth (318) adapted to engage the ratchet teeth (138) and a tubular coupling sleeve (310) captivated for rotation about said one shell and provided with an internal thread (320) for threadable coupling with the external thread (220) disposed on the other of said shells, so that when said threads (220, 320) are engaged rotation of the coupling nut in one direction draws the shells (100, 200) together, said coupling nut characterized by:

said medial tooth (318) being normally biased by said spring beam (316) radially outwardly from engagement with said ratchet teeth (138);

drive means (322) cooperatively associated with said spring beam (316) for driving said medial tooth (318) thereof into engagement with the ratchet teeth;

actuating means (410, 406, 408) movable between a first and locking position to a second and unlocking position for actuating the drive means, said locking position driving the spring beam into engagement with the ratchet teeth to prevent rotation of the coupling nut and said unlocking position allowing the spring beam to disengage with the ratchet teeth to allow rotation of the coupling nut; and bias means (422) for normally biasing the actuating means into the locking position.

2. The coupling nut as recited in claim 1, characterized by said coupling sleeve (310) including an opening (312) extending radially therethrough and said drive means (322) including a drive pin (322) of rigid material mounted within said opening (312) for movement radially therewithin, said drive pin (322) having opposite ends (324, 326) with one end (324) being adapted to abut against spring beam (316) and the other end (326) being adapted to be operated on by said actuating means (410, 406, 408) moving from the locking position to the unlocking position.

3. The coupling nut as recited in claim 2, characterized by said actuating means (410, 406, 408) including an actuating sleeve (410) having an inner surface (406) thereof telescoped over coupling sleeve (310) for rotation thereabout and said bias means (422) including a rotary lost motion connection between said actuating sleeve (410) and said coupling sleeve (310) whereby the coupling sleeve (310) may be turned by turning actuating sleeve (410), said inner surface (406) including a pair of angularly spaced undercuts (408) adapted to receive said other end (326) of said drive pin (322) when actuating sleeve (410) is turned from the locking position to the unlocking position, the locking position registering the inner surface (406) with drive pin (322) to drive spring beam (316) and associated medial tooth (318) radially inward into engagement with the ratchet teeth and the unlocking position registering an undercut with the drive pin and allowing the spring beam to deflect its medial tooth and associated drive pin radially outward from engagement.

4. The coupling nut as recited in claim 3, characterized by said lost motion connection comprising a drive foot (420) extending from one sleeve (410) being adapted to rotate between angular sidewalls (336, 338) of a limit cavity (334) disposed in the other sleeve (310) and said bias means (422) comprising said sleeves (310, 410) including, respectively, spring cavities (330, 412) including spaced spring seats (328, 414; 332, 416) and an operating spring (422) received in each of the spring cavities such that the operating spring has at least one end disposed against a spring seat in one sleeve and its other end disposed against a spaced spring seat in the other sleeve, each spring cavity (330, 412) being in register in the locked position and said sidewalls (336, 338) being angularly spaced a sufficient amount such that rotation of foot (420) against one of the sidewalls constrains the sleeves (310, 410) to rotate as a unit and one of the undercuts (408) to ultimately register with drive pin (332).

5. The coupling nut as recited in claim 4, characterized by said drive pin (322) and spring beam (316) being integrally formed with the drive pin (322) registered with said medial tooth (318).

6. An anti-decoupling mechanism for an electrical connector assembly of the type having first and second shells (100, 200) connectable in end-to-end relation and a coupling nut (300) for securing the sheels together, one of said shells (100) including a plurality of ratchet teeth (138) arranged annularly and extending outwardly therefrom and said second shell (200) having thread (220) on the outside surface thereof, said coupling nut including a cylindrical coupling sleeve (310) having inner and outer walls (306, 308) and thread (320) on the inner wall adapted to engage the external thread (220) on the second shell (200) so that when the threads (220, 320) are engaged rotation of the coupling nut in one direction draws the shells (100, 200) together, said anti-decoupling mechanism characterized by:

a straight spring beam (316) having opposite ends mounted to the inner wall (306) of said coupling sleeve (310) and a medial tooth (318) thereof adapted to engage successive of the ratchet teeth (138), said spring beam (316) being normally biased out of engagement with the ratchet teeth;

locking means (312, 322) carried by the coupling sleeve for locking the coupling sleeve from rotation relative to the connected shells (100, 200), said locking means comprising said coupling sleeve (310) including an opening (312) extending radially between its inner and outer walls (306, 308) and a rigid drive pin (322) disposed in said opening (312), said opening (312) being in register with said spring beam (316) and drive pin (322) being adapted to drive against said spring beam (316) when in a first and locking position; and unlocking means (410, 406, 408) movable from said first and locking position to a second and unlocking position for unlocking coupling sleeve (310) relative to the connected shells, said unlocking position permitting the spring beam (316) to normally bias the drive pin (322) radially outward.

7. The invention as recited in claim 6, wherein said unlocking means (410, 406, 408) includes an actuating sleeve (410) having an inner surface (406) including first and second angularly spaced undercuts (408A, 408B), the actuating sleeve (410) being telescoped over the coupling sleeve (310) for rotation between said locking and unlocking positions and comprising a rotary lost motion connection between said sleeves (310, 410) whereby the coupling sleeve (310) may be turned by rotation of said actuating sleeve (410), said inner surface (406) forcing the drive pin (322) radially inwardly against spring beam (316) when in the locking position and said undercuts (408A, 408B) registering with and receiving the drive pin (322) biased radially outwardly by the spring beam when in the unlocking position.

8. The invention as recited in claim 6, wherein said unlocking means (410, 406, 408) includes an actuating sleeve (410) having an inner surface (406) and angularly spaced undercuts (408A, 408B), said drive pin (322) includes spaced ends (324, 326) with one end (324) thereof being adapted to contact said spring beam (316) and the other end (326) adapted to abut the inner surface (406) of said actuating sleeve (410) and be received in said undercuts (408A, 408B), said other end (326) being dome shaped and said undercuts (408A, 408B) including a cam (424) leading to a recess (426) with said recess (426) being spaced radially outward from inner suface (406) to receive an axial end portion of drive pin (322) when driven radially therewithin upon rotation of the actuating sleeve (410) to said unlocking position.

9. The invention as recited in claim 7, characterized by bias means (330, 412, 422) for normally biasing coupling sleeve (310) and actuating sleeve (410) into the first and locking position.

10. The invention as recited in claim 9, wherein said coupling sleeve (310) includes a radial flange (314) and said first shell (100) includes an annular shoulder (130) for limiting axial movement of coupling sleeve (310) therealong, characterized by said bias means (330, 412, 422) comprising radial flange (314) including a spring cavity (330) having spaced spring seats (328, 332), said actuating sleeve including a second radial flange (418) including a second spring cavity (412) having spaced spring seats (414, 416), an operating spring (422) adapted to be received in spring cavities (330, 412), said radial flanges (314, 418) abutting and said spring cavities (330, 412) confronting to form a spring housing therebetween to captivate the operating spring (422) therewithin and said rotary lost motion connection resulting from coupling nut (300) rotation being determined by actuating nut (400) rotation and operating spring (422) compression.

11. The invention as recited in claim 10, characterized by a limit cavity (334) having spaced sidewalls (336, 338) disposed in the coupling sleeve (310) being adapted to receive and limit movement of a drive foot (420) extending from the actuating sleeve (410), whereby as the actuating sleeve (410) is corotated relative to the coupling sleeve (310) the drive foot (420) advances in the limit cavity toward sidewall (336, 338) in a lost motion rotation into contact whereby the foot constrains the coupling sleeve to rotate as a unit with the actuating sleeve.

12. The invention as recited in claim 11, characterized by said limit cavity (334) being on radial flange (314) of coupling sleeve (310) and drive foot (420) being disposed on radial flange (418) of the actuating sleeve (410).

13. The invention as recited in claim 7, characterized by said coupling sleeve (310) being provided with a plurality of drive pins (322) and their associated spring beams (316) disposed in respective openings (312).

14. The invention as recited in claim 7, characterized by said drive pin (322) being immovably secured to said spring beam (316).

* * * * *